US006634709B1

(12) United States Patent
Hetherington

(10) Patent No.: US 6,634,709 B1
(45) Date of Patent: Oct. 21, 2003

(54) MACHINE-PRESSABLE CHAIR COVER

(76) Inventor: Korry K. Hetherington, 7819 Custer Rd., Bethesda, MD (US) 20814

( * ) Notice: Subject to any disclaimer, the term of this patent is extended or adjusted under 35 U.S.C. 154(b) by 70 days.

(21) Appl. No.: 09/708,416

(22) Filed: Nov. 9, 2000

(51) Int. Cl.[7] ..... A47C 31/00
(52) U.S. Cl. ..... 297/229; 297/225; 297/228.12
(58) Field of Search ..... 297/229, 225, 297/219.1, 228.12

(56) References Cited

U.S. PATENT DOCUMENTS 2,797,743 A * 1/1957 Rodtz ..... 297/229 X
2,820,510 A * 1/1958 Sugarman ..... 297/228
3,116,953 A * 1/1964 Sugarman ..... 297/225
5,494,330 A * 2/1996 Fotsch ..... 297/219.1
5,690,380 A * 11/1997 Waters ..... 297/225 X
6,079,778 A * 6/2000 Lindberg ..... 297/223
6,116,685 A * 9/2000 White et al. ..... 297/218.1
6,354,661 B1 * 3/2002 Moss ..... 297/224

* cited by examiner

*Primary Examiner*—Anthony D. Barfield
(74) *Attorney, Agent, or Firm*—Dorsey & Whitney LLP

(57) ABSTRACT

A machine-pressable chair cover is disclosed. The machine-pressable chair cover comprises a series of flaps, a seat cover and a chair-back cover that can lay flat when not in use, enabling the machine-pressing of the machine-pressable chair cover. Machine-pressing of the machine-pressable chair cover drastically reduces the maintenance costs and time of the machine-pressable chair cover.

11 Claims, 8 Drawing Sheets

MACHINE-PRESSABLE CHAIR COVER

FIELD OF THE INVENTION

The invention relates to furniture covers, and more particularly to rental chair covers.

BACKGROUND OF THE INVENTION

Chair covers are placed over numerous types of chairs to hide unsightly used chairs and/or to provide a decorative, attractive look for banquets, weddings, balls, proms, and other special events. Indeed, many chair covers are specially designed, with various colors, patterns or prints to provide a specific theme for special events. Consequently, chair covers have become very popular and widely used.

Unfortunately, prior-art chair covers are also quite difficult to maintain. Through constant use, chair covers frequently become wrinkled. As such, it is often necessary to iron chair covers. However, prior-art chair covers cannot be pressed in an industrial pressing machine, such as a mangle roller or steam press. This is due to the fact that prior-art chair covers cannot lay flat without significant folding and overlap.

Consequently, the only feasible way to iron wrinkles out of prior-art chair covers is to hand iron them. Hand ironing requires individual laborers to do the hand ironing and typically takes five to fifteen minutes per chair cover to complete. Clearly, the necessity of using individual laborers to do the hand ironing and the time required makes the maintenance of prior-art chair covers both extremely expensive and time consuming.

SUMMARY OF THE INVENTION

The present invention is a machine-pressable chair cover. As the name implies, the machine-pressable chair cover may be pressed in an industrial pressing machine, such as a mangle roller or steam press. This is due to the fact that machine-pressable chair cover can lay flat. Consequently, the machine-pressable chair cover can be pressed in approximately thirty seconds. As such, a single pressing machine operator can press a batch of machine-pressable chair covers in significantly less time than required for individual laborers to hand iron an equivalent batch of prior art chair covers. This drastically reduces the maintenance costs and time of the machine-pressable chair cover.

An embodiment of the machine-pressable chair cover comprises a series of four flaps: a front flap, two side flaps and a rear flap, and a seat cover and a chair-back cover. When the machine-pressable chair cover is in use on a chair, the flaps hang down from the chair, hiding the underneath of the chair, and usually some or all of the chair legs, from view. The seat cover covers the seat of the chair. The chair-back cover, which includes a cover front a cover back that form a pocket, slides over the back of the chair, covering the back of the chair within the pocket. When the machine-pressable chair cover is to be pressed, it may be laid flat with the flaps spread out and the chair-back cover folded over on the rear flap so that the front flap, side flap and chair cover are lay flat in a single plane.

DETAILED DESCRIPTION OF THE INVENTION

Figure 1A:
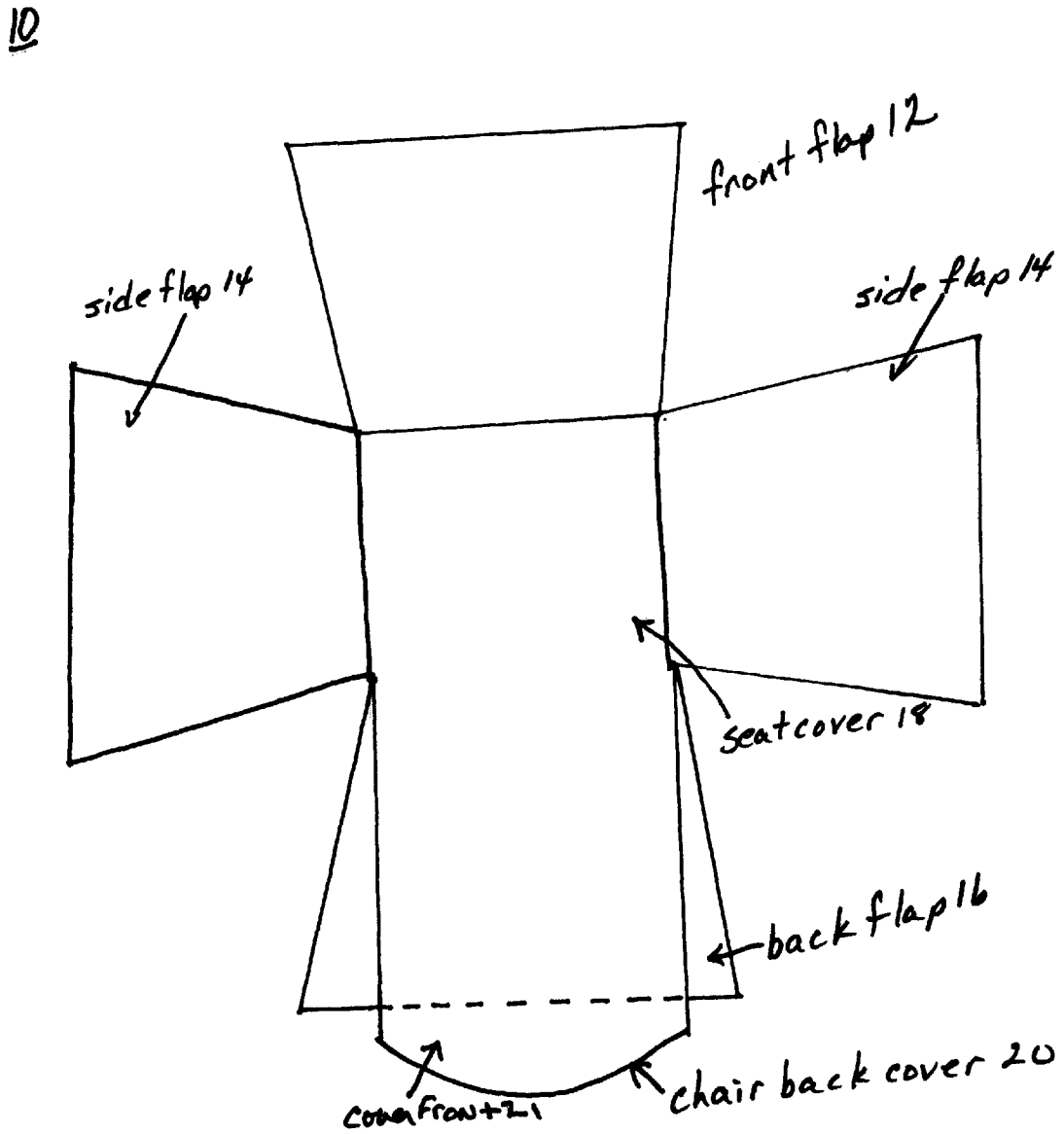
FIGS. 1*a* and 1*b* depict overhead views of an embodiment of the present invention.
Figure 1B:
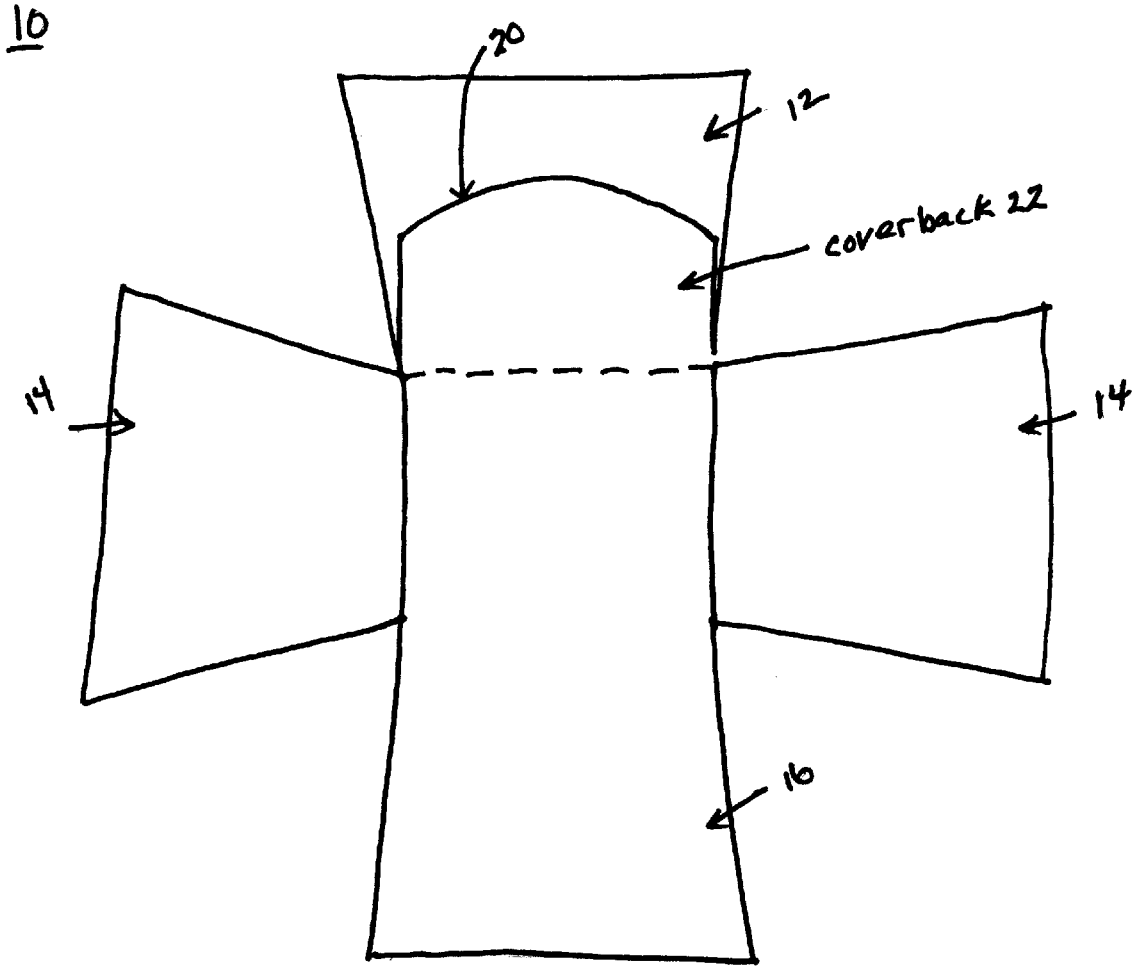

FIGS. 1*a*–1*b* illustrate an embodiment of the present invention, a machine-pressable chair cover 10. The machine-pressable chair cover 10 comprises a front flap 12, side flaps 14, a rear flap 16, a seat cover 18 and a chair-back cover 20. When the machine-pressable chair cover 10 is in use on a chair (see FIGS. 2*a*–2*b*), the front flap 12 hangs down in the front of the chair. The front flap 12 is preferably connected to the seat cover 18. Generally, the bottom of the front flap 12 is wider than the top of the front flap 12, as seen in FIGS. 1*a*–1*b*. Since chair legs typically taper outwards, this allows the front flap 12 to cover the front legs of the chair when in use. If the chair legs do not taper outwards (e.g., the chair legs are perpendicular to the floor), the front flap 12 may be the same width or approximately the same width from top to bottom. Accordingly, the taper of the front flap 12 may be adjusted according to the leg taper of the chair type on which the machine-pressable chair cover 10 is designed to be used.

When the machine-pressable chair cover 10 is in use on a chair (see FIGS. 2*a*–2*b*), the side flaps 14 hang down on opposite sides of the chair. The side flaps 14 are preferably connected to the seat cover 18. The side flaps 14 are generally of the same construction as the front flap 12. Accordingly, the bottoms of the side flaps 14 are generally wider than the tops of the side flaps 14, as seen in FIGS. 1*a*–1*b*. Likewise, the taper of the side flaps 14 may be adjusted according to the chair leg taper.

When the machine-pressable chair cover 10 is in use on a chair (see FIGS. 2*a*–2*b*), the rear flap 16 hangs down in the back of the chair. The rear flap 16 is preferably connected to the chair back cover 20. Indeed, the rear flap 16 may form one continuous piece with the chair back cover 20, as seen in FIG. 1*b* and discussed in detail below. As with the front flap 12 and the side flaps 14, the rear flap 16 generally tapers outwards from top to bottom. Also, the rear flap 16 taper may be adjusted according to the chair leg taper. When the machine-pressable chair cover 10 is in use on a chair (see FIGS. 2*a*–2*b*), the seat cover 18 rests on and covers the seat of the chair. The seat cover 18 is generally square, although it may be shaped to fit any chair seat shape. For example, if the chair seat is tapered outwards from back to front, the seat cover 18 may be likewise tapered. The seat cover 18 is preferably connected to the front flap 12, side flaps 14 and the chair-back cover 20. As seen in FIG. 1*a*, and discussed in detail below, the seat cover 18 may form one continuous piece with the chair-back cover 20.

Figure 2A:
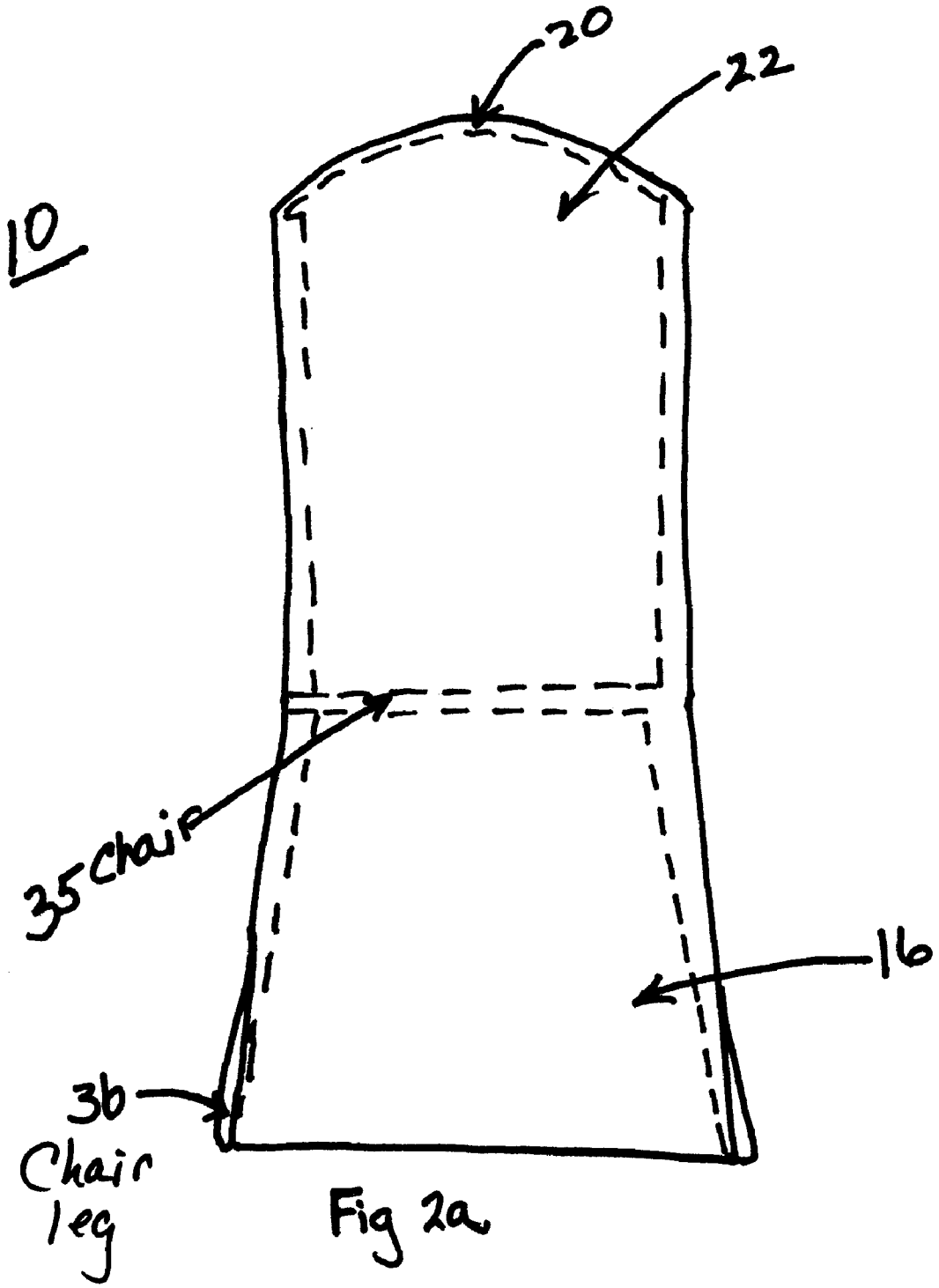
FIGS. 2*a* and 2*b* depict a rear view and overhead view, respectively, of an embodiment of the present invention in use.
Figure 3:
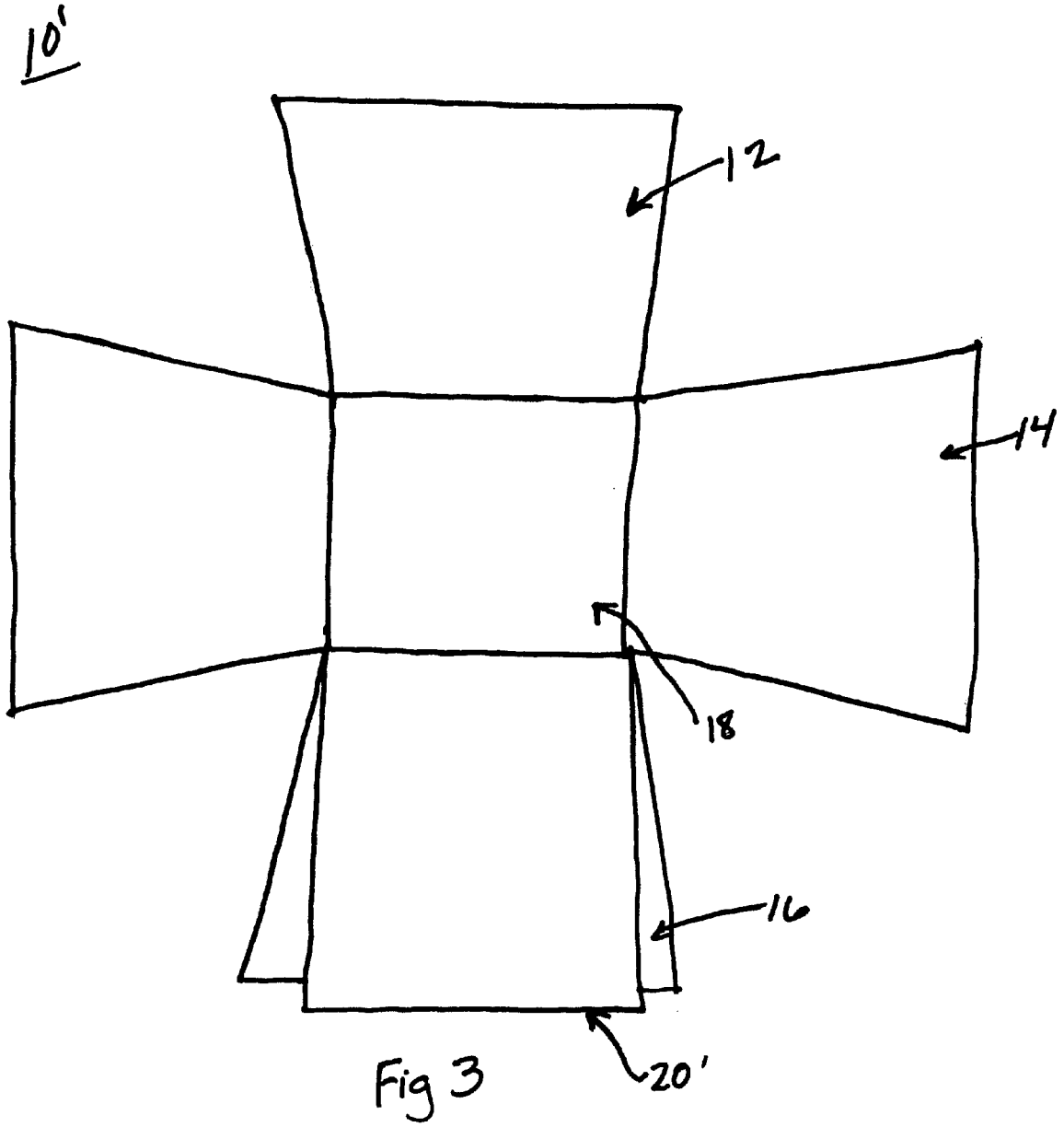
FIG. 3 depicts an overhead view of another embodiment of the present invention with a straight top.
Figure 4:
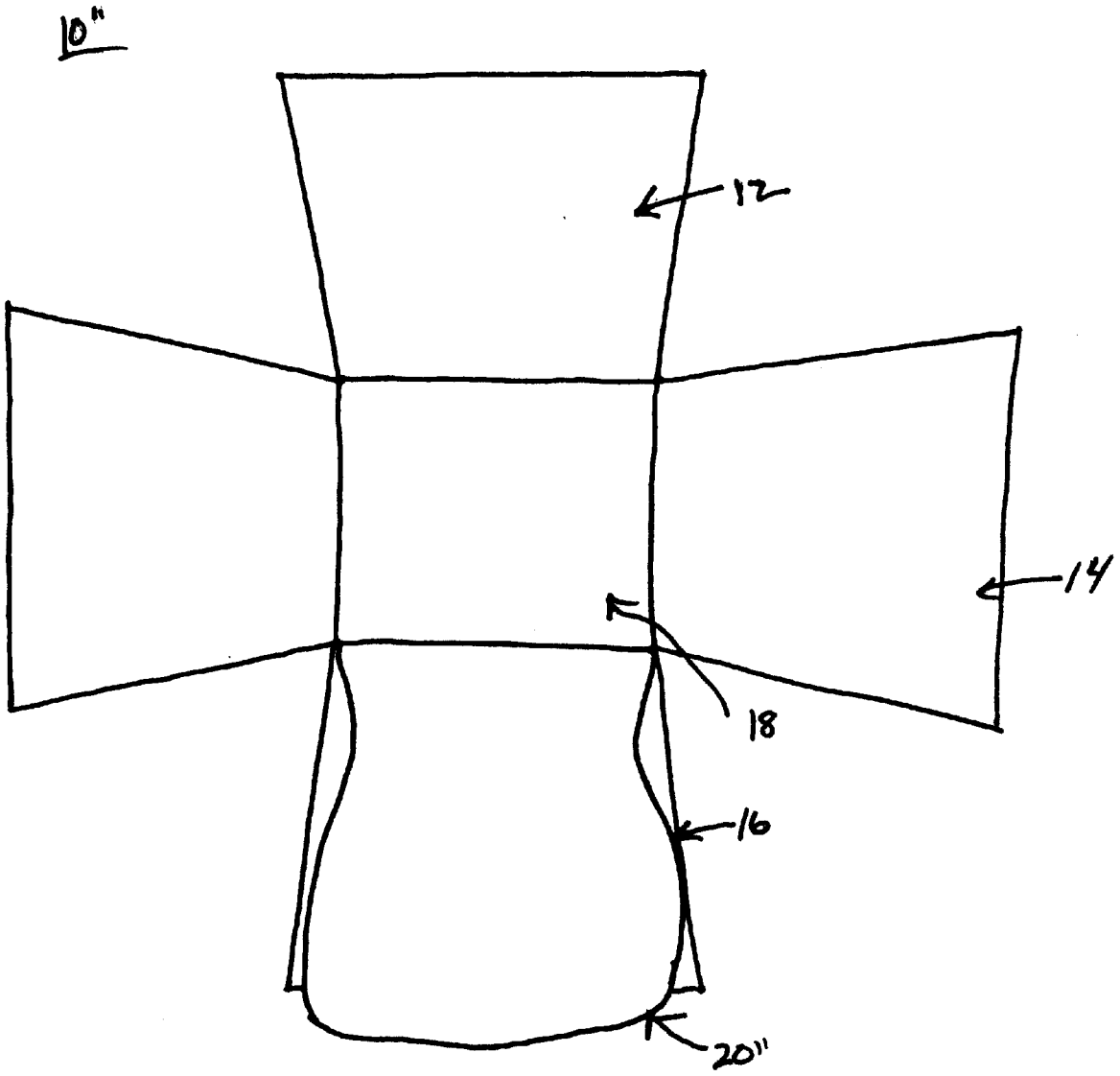
FIG. 4 depicts an overhead view of another embodiment of the present invention with a hourglass top.

When the machine-pressable chair cover 10 is in use on a chair (see FIGS. 2*a*–2*b*), the chair-back cover 20 fits over and covers the back of the chair. The shape of the chair-back cover 20 may be modified to fit over almost any chair back. For example, the chair-back cover 20 shown in FIGS. 1*a*–1*b* fits over a round-top chair back. FIG. 3 illustrates a chair-back cover 20' that fits over a straight chair back, while FIG. 4 illustrates a chair-back cover 20" that fits over a hourglass-back chair.

In the embodiment shown in FIG. 1*a*, the chair-back cover 20 comprises a cover front 21 and a cover back 22 that form between them a chair-back pocket (not shown). The chair-back pocket is an open space into which the chair back fits when the machine-pressable chair cover 10 is in use on a chair. When the machine-pressable chair cover 10 is in use on a chair, the cover front 21 faces the front of the chair. The cover front 21 may be the portion of the chair-back cover 20 that is connected to the seat cover 18. As shown in FIG. 1*a*, the cover front 21 may form one continuous piece with the seat cover 18. Alternatively, the cover front 21 and the seat cover 18 may be separate pieces sown, or otherwise connected, together.

AWhen the machine-pressable chair cover 10 is in use on a chair, the cover back 22 faces the rear of the chair. In the embodiment shown in FIG. 1*b*, the cover back 22 is the portion of the chair-back cover 20 that is connected to the rear flap 16. As shown in FIG. 1*b*, the cover back 22 may form one continuous piece with the rear flap 16. Alternatively, the cover back 22 and the rear flap may be separate pieces sown, or otherwise connected, together.

The machine-pressable chair cover 10 may be made of a variety of fabrics, including rayon, cotton, nylon, satin, silk, polyester, stretchable polyester, Lycra®, Spandex®, cotton-polyester, other fabric blends and combinations of fabrics, etc. Preferably, the machine-pressable chair cover 10 fabric is tolerant of machine pressing. A primary advantage of the machine-pressable chair cover 10 is that its design enables the machine-pressable chair cover 10 to be machine pressed, for example, in mangle roller or steam press. Unlike other chair covers, the machine-pressable chair cover 10 can lay flat, as seen in FIGS. 1*a*–1*b*, so that the machine-pressable chair cover 10 can be fed through a mangle roller or placed into a steam press for quick, and easy, pressing. Compared to other chair covers, which must be hand-ironed, this ability to be machine pressed reduces the pressing time of the machine-pressable chair cover 10 from five minutes, or more, to approximately thirty seconds. Consequently, the machine-pressable chair cover 10 has greatly reduced maintenance costs.

As noted above, FIGS. 2*a*–2*b* illustrate the machine-pressable chair cover 10 in use on a round-top chair 35. Specifically, FIG. 2*a* shows the machine-pressable chair cover 10 on the chair 35 (shown in dashed lines) as seen from behind the chair 35. Consequently, the cover back 22 of the chair-back cover 20 and the rear flap 16 are shown in FIG. 2a. The legs 36 of the chair 35 are also shown, partially protruding from the rear flap 16. The rear flap 16 may be designed to completely cover the chair legs 36. For example, the rear flap 16 may be made wider at the bottom or fasteners (see below) may be provided to attach the rear flap 16 to the side flaps 14 in order to cover the chair legs 36 completely.

Figure 2B:
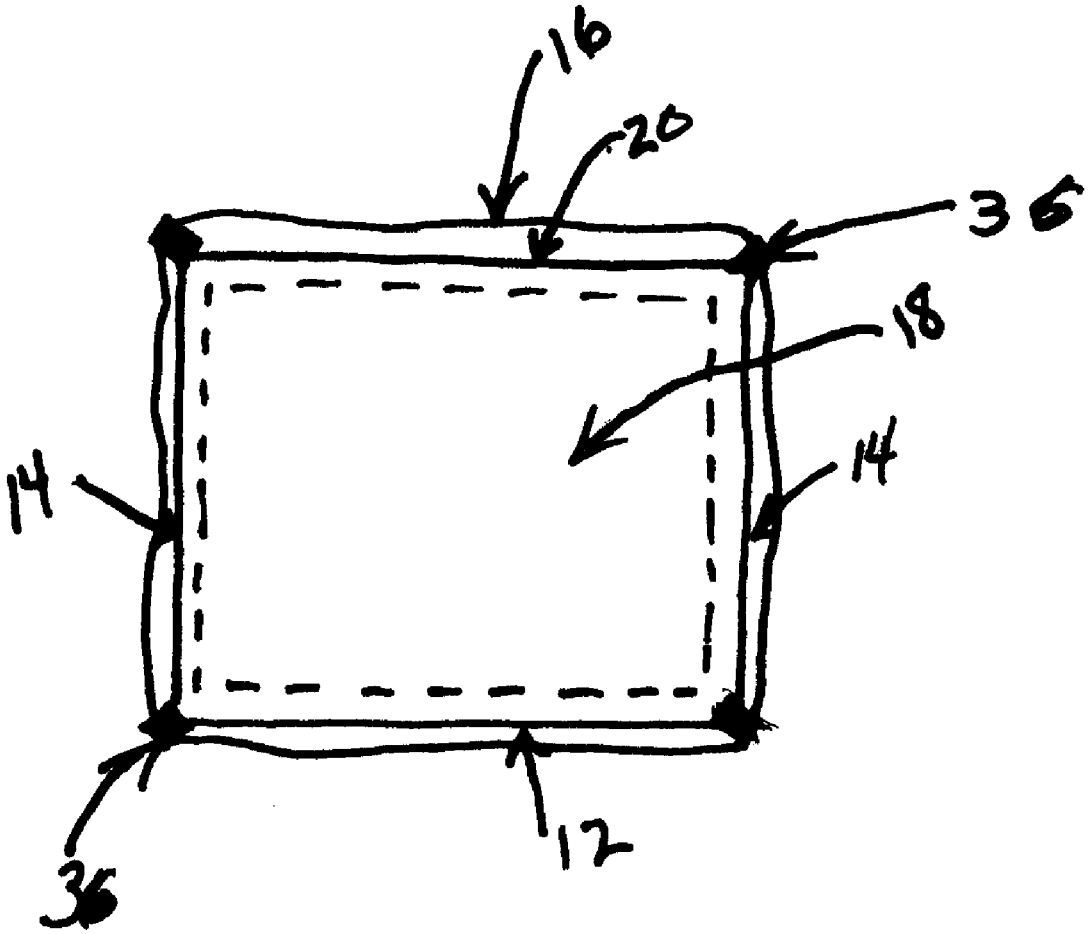

FIG. 2*b* shows the machine-pressable chair cover 10 on the chair 35 (shown in dashed lines) as seen from above the chair 35. The seat cover 18 and the top of the chair-back cover 20 are shown covering the seat of the chair 35 and the back of the chair 35, respectively. Portions of the front flap 12, side flaps 14 and the rear flap 16 are also shown. As with FIG. 2*a*, portions of the chair legs 36 are shown protruding from between each of the flaps. The front flap 12 and the side flaps 14, similarly to the rear flap 16, may be designed to completely cover the chair legs 36. The front flap 12 and side flaps 14 may likewise be made wider at the bottom or fasteners (see below) may be provided to attach the front flap 12 to the side flaps 14 and the side flaps 14 to the rear flap 16 in order to cover the chair legs 36 completely.

The machine-pressable chair cover 10 may be designed to fit any type of chair. For example, the chair-back cover 20 may be shaped to fit any shape of chair back. This includes straight top, round top, flared top, ladder back, ballroom or Chivari chairs. Likewise, the seat cover 18 may be shaped to fit any shape of seat shape. This includes square, round and flared seats. Moreover, the flaps (front flap 12, side flaps 14 and rear flap 16) may be designed to fit chairs with different types of legs. As described above, this may include chairs with straight and flared legs, as well as folding chairs. For example, the front flap 12 may be the same or a different shape or size than the side flaps 14 and/or the rear flap 16 depending on the chair.

FIG. 3 illustrates an alternative machine-pressable chair cover 10' designed to fit a different type of chair than the embodiment described above. The machine-pressable chair cover 10' shown is designed for straight-top chairs. Accordingly, the chair-back cover 20' has a generally straight top so that the chair-back cover 20', and its component cover front 21' and cover back 22', will fit snugly over a straight-top chair.

Likewise, FIG. 4 illustrates an alternative machine-pressable chair cover 10" designed to fit a hourglass-back chair. Accordingly, the chair-back cover 20", and its component cover front 21" and cover back 22", is hourglass shaped so that it will fit snugly over the hourglass-back chair. The chair-back cover 20" may include elastic or stretchable material so that the narrower portion can fit over the wider top of the hourglass-back chair as the chair-back cover 20" is being pulled over the back of the hourglass-back chair.

Figure 5:
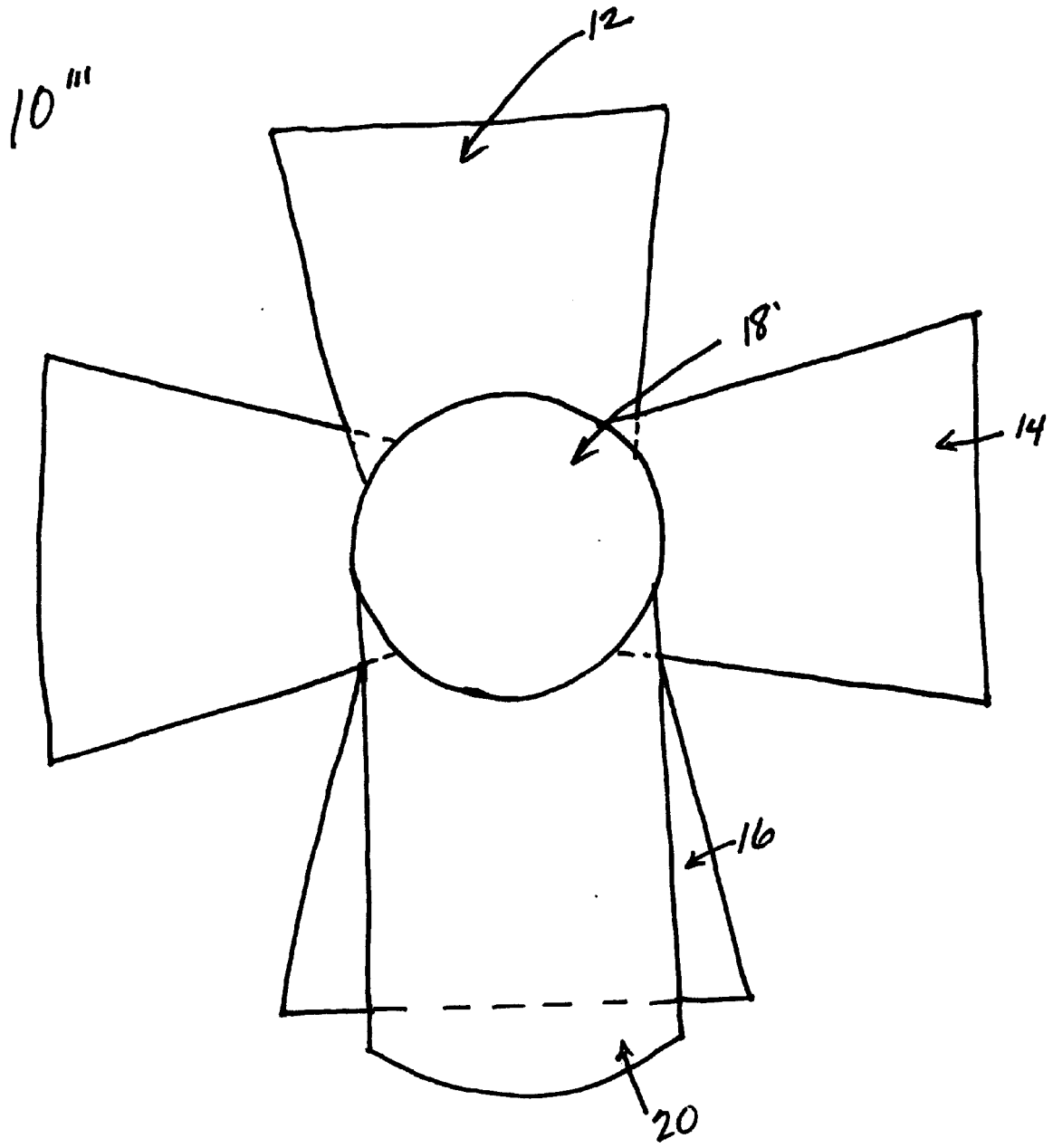
FIG. 5 depicts an overhead view of another embodiment of the present invention with a round seat cover.

Referring to FIG. 5, another alternative machine-pressable chair cover 10'" is shown. The machine-pressable chair cover 10'" is designed for round-seat chairs. Consequently, the seat cover 18' is round so that it will fit snugly over the round seat. The flaps and the chair-back cover 20 are approximately the same shape, although they may slightly overlap one another when the machine-pressable chair cover 10'" is laid flat, as seen in FIG. 5.

Figure 6:
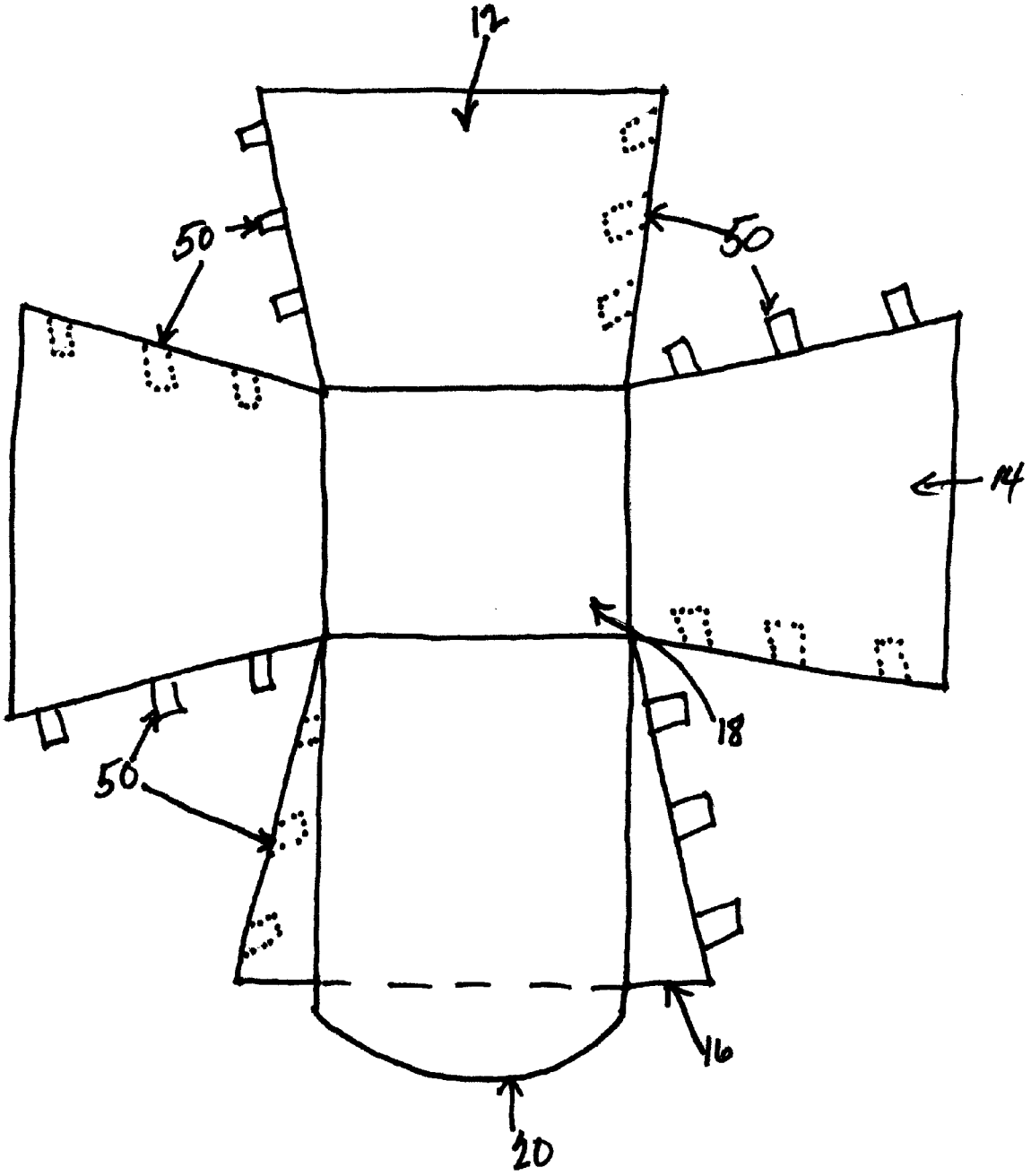
FIG. 6 depicts an overhead view of another embodiment of the present invention with fasteners.

As mentioned above, the machine-pressable chair cover 10 may include fasteners for attaching the flaps (i.e., the front flap 12, side flaps 14 and the rear flap 16) to one another. One advantage of attaching the flaps together is that the chair legs will remain covered, as mentioned above. Another advantage of attaching the flaps together is that the seat cover 18 will be more securely held on the chair seat and will be less likely to slide around when sat upon. The machine-pressable chair cover 10 may also include fasteners elsewhere (not shown) for securing the seat cover 18 to the chair seat. FIG. 6 illustrates velcro fasteners 50 on the flaps. Other types of fasteners, for example, zippers, snaps, magnets, buttons, etc., may be used. The velcro fasteners 50 extending from each flap engage with the velcro fasteners 50, shown with dashed lines, on the back of the neighboring flap. The velcro fasteners 50 may also be positioned so that each flap may be separately secured to the chair legs. The number of velcro fasteners 50 is variable. These fasteners also allow the flaps to be adjustable to cover both straight and splayed leg chairs without a sagging or baggy appearance. One can move the flaps closer to one another by connecting the velcro fasteners more towards the center of each flap.

It is also noted that the machine-pressable chair cover 10 may include other decorative features, such as lace, ribbons, bows etc. Likewise the fabric may be any color or pattern.

While the invention has been described with reference to the exemplary embodiments thereof, those skilled in the art will be able to make various modifications to the described embodiments of the invention without departing from the true spirit and scope of the invention. The terms and descriptions used herein are set forth by way of illustration only and are not meant as limitations. Those skilled in the art will recognize that these and other variations are possible within the spirit and scope of the invention as defined in the following claims and their equivalents.

What is claimed is:

1. A machine-pressable chair cover, comprising;

a front flap, wherein the front flap hangs down in front of a chair when the machine-pressable chair cover is in use on the chair;

a side flap, wherein the side flap hangs down from a seat cover when the machine-pressable chair cover is in use on the chair;

a rear flap, wherein the rear flap hangs down from a chair-back cover when the machine-pressable chair cover is in use on the chair;

the seat cover, connected to the front flap and side flaps, wherein the seat cover covers a seat of the chair when the machine pressable chair cover is in use on the chair;

the chair-back cover, connected to the seat cover and the rear flap, wherein the chair-back cover encloses a back of the chair when the machine-pressable chair cover is in use on the chair; and wherein the front flap, side flap and chair back cover are capable of being spread out and spaced apart in order to lie flat in a single plane.

2. The machine-pressable chair cover of claim 1, wherein the chair back cover comprises:

a cover front; and a cover back, wherein a chair-back pocket is formed by the cover front and cover back so that the back of the chair is positioned within the chair back pocket when the machine-pressable chair cover is in use on the chair.

3. The machine-pressable chair cover of claim 2, wherein the cover front and the seat cover form one continuous piece.

4. The machine-pressable chair cover of claim 2, wherein the cover back and the rear flap form one continuous piece.

5. The machine-pressable chair cover of claim 1, wherein the front flap, side flaps and rear flap each comprise a top and bottom and the front flap, side flaps and rear flap each taper outwards from the top to the bottom.

6. The machine-pressable chair cover of claim 1, wherein the chair-back cover has a round top so that the machine-pressable chair cover fits round-top chairs.

7. The machine-pressable chair cover of claim 1, wherein the chair-back cover has a straight top so that the machine-pressable chair cover fits straight-top chairs.

8. The machine-pressable chair cover of claim 1, wherein the seat cover is square so that the machine-pressable chair cover fits square-seat chairs.

9. The machine-pressable chair cover of claim 1, wherein the seat cover is round so that the machine-pressable chair cover fits round-seat chairs.

10. The machine-pressable chair cover of claim 1, further comprising fasteners located on the front flap, side flaps and rear flap.

11. The machine-pressable chair cover of claim 10, wherein the fasteners are velcro fasteners.

* * * * *